US009637954B2

(12) United States Patent
Nagata et al.

(10) Patent No.: US 9,637,954 B2
(45) Date of Patent: May 2, 2017

(54) VEHICLE DOOR OUTER HANDLE STRUCTURE

(71) Applicant: AISIN SEIKI KABUSHIKI KAISHA, Kariya-shi, Aichi (JP)

(72) Inventors: Koichi Nagata, Chiryu (JP); Nobukazu Araki, Hekinan (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 0 days.

(21) Appl. No.: 14/899,986

(22) PCT Filed: Jun. 18, 2014

(86) PCT No.: PCT/JP2014/066148

§ 371 (c)(1),
(2) Date: Dec. 18, 2015

(87) PCT Pub. No.: WO2014/203928

PCT Pub. Date: Dec. 24, 2014

(65) Prior Publication Data

US 2016/0138302 A1 May 19, 2016

(30) Foreign Application Priority Data

Jun. 21, 2013 (JP) ..... 2013-130459

(51) Int. Cl.
*E05B 3/00* (2006.01)
*E05B 77/06* (2014.01)
(Continued)

(52) U.S. Cl.
CPC ..... *E05B 77/06* (2013.01); *E05B 1/003* (2013.01); *E05C 1/085* (2013.01); *E05C 1/10* (2013.01); *E05B 85/16* (2013.01)

(58) Field of Classification Search
CPC ..... E05B 77/06; E05B 1/003; E05B 85/16; E05B 77/04; E05B 77/02
(Continued)

(56) References Cited

U.S. PATENT DOCUMENTS 3,719,248 A * 3/1973 Breitschwerdt ..... E05B 77/06 180/271
5,092,642 A * 3/1992 Lindmayer ..... E05B 77/42 292/201
(Continued)

FOREIGN PATENT DOCUMENTS

JP 2003-013630 A 1/2003
JP 2009-243101 A 10/2009
(Continued)

OTHER PUBLICATIONS

International Search Report (PCT/ISA/210) issued on Aug. 5, 2014, by the Japanese Patent Office as the International Searching Authority for International Application No. PCT/JP2014/066148.
(Continued)

*Primary Examiner* — Kristina Fulton
*Assistant Examiner* — Faria Ahmad
(74) *Attorney, Agent, or Firm* — Buchanan Ingersoll & Rooney PC

(57) ABSTRACT

A door opening prevention mechanism includes a lever member rotatable relative to a base member and swingable in a vehicle inside-and-outside direction, and an urging member to bias the lever member toward a set position. The lever member is held in the set position when an outer handle is located in a door closing position when a given inertial force does not act in a vehicle outside direction during a vehicle collision, and swings in the vehicle outside direction from the set position to be moved to a locked position against an urging force of the urging member when
(Continued)

the inertial force acts. When the lever member is in the set position, movement of a connection lever in a door opening direction is allowed. When the lever member is located in the locked position, movement of the connection lever in the door opening direction is restricted.

2 Claims, 4 Drawing Sheets

(51) Int. Cl.
*E05B 1/00* (2006.01)
*E05C 1/08* (2006.01)
*E05C 1/10* (2006.01)
*E05B 85/16* (2014.01)

(58) Field of Classification Search
USPC ..... 292/336.3, DIG. 22, DIG. 30
See application file for complete search history.

(56) References Cited

U.S. PATENT DOCUMENTS 5,669,642 A * 9/1997 Kang ..... E05B 77/06 292/336.3
9,062,477 B2 * 6/2015 Da Deppo ..... E05B 77/06
9,404,292 B2 * 8/2016 Da Deppo ..... E05B 77/06
2012/0074718 A1 * 3/2012 Nagata ..... E05B 77/06 292/336.3
2014/0292005 A1 * 10/2014 Bendel ..... E05B 77/06 292/336.3
2015/0345188 A1 * 12/2015 Puscas ..... E05B 85/14 292/336.3
2016/0076280 A1 * 3/2016 Rudraraju ..... E05B 77/06 292/336.3

FOREIGN PATENT DOCUMENTS

JP 2009-243102 A 10/2009
JP 2012-021326 A 2/2012
JP 2012-092640 A 5/2012

OTHER PUBLICATIONS

Written Opinion (PCT/ISA/237) issued on Aug. 5, 2014, by the Japanese Patent Office as the International Searching Authority for International Application No. PCT/JP2014/066148.

* cited by examiner

VEHICLE DOOR OUTER HANDLE STRUCTURE

TECHNICAL FIELD

The present invention relates to a door outer handle structure for a vehicle, and more particularly, to a door outer handle structure for a vehicle, including a base member fixed to a door of the vehicle, an outer handle provided to the base member so as to be swingable in a vehicle inside-and-outside direction and operable between a door closing position and a door opening position being away from the door closing position in a vehicle outside direction, a link mechanism capable of transmitting a door opening operation of the outer handle as an unlatching operation of a door latch mechanism, and a door opening prevention mechanism configured to restrict actuation of a component of the link mechanism in a door opening direction (disable functions of the link mechanism) due to a given inertial force acting in the vehicle outside direction for the door in the event of collision of the vehicle.

The component of the link mechanism is actuated in the door opening direction in the event of collision of the vehicle due to, for example, opening actuation of the outer handle, which is caused by the given inertial force acting in the vehicle outside direction on the door in the event of collision of the vehicle. Further, the unlatching operation of the door latch mechanism corresponds to actuation for bringing the door latch mechanism in a latching state into an unlatching state. While the door latch mechanism is in the latching state, the closed door of the vehicle cannot be opened with a force in the vehicle outside direction. While the door latch mechanism is in the unlatching state, the closed door of the vehicle can be opened with the force in the vehicle outside direction.

BACKGROUND ART

The above-mentioned type of door outer handle structure for a vehicle is described in, for example, JP 2012-92640 A. The door opening prevention mechanism includes a lever member rotatable from a set rotational position at least to a retracted rotational position in a vehicle inside direction, and an urging/biasing member configured to urge the lever member toward the retracted rotational position. The lever member is set to be held in the set rotational position when the outer handle is located in the door closing position under a state in which the inertial force does not act, rotate in the vehicle inside direction from the set rotational position to be moved to the retracted rotational position by an urging force of the urging member in an early stage of an operation of the outer handle from the door closing position to the door opening position when the operation is performed under a state in which the inertial force does not act, rotate in the vehicle outside direction from the set rotational position to be moved to a locked rotational position against the urging force of the urging member when the inertial force acts (or is set to stay in the set rotational position against the urging force of the urging member when the inertial force acts), so as to restrict movement of the component in the door opening direction when the lever member is located in the set rotational position or the locked rotational position, and allow the movement of the component in the door opening direction when the lever member is located in the retracted rotational position.

In the door outer handle structure for a vehicle described in JP 2012-92640 A, a part of the lever member of the door opening prevention mechanism is configured to be engageable with and retractable from a projection provided to a connection lever that is one of the components of the link mechanism. When the lever member is located in the set rotational position or the locked rotational position, the part of the lever member is present on/within a movement locus of the projection provided to the connection lever of the link mechanism in the door opening direction so as to restrict the movement of the projection in the door opening direction.

SUMMARY OF INVENTION

Incidentally, in the door outer handle structure for a vehicle described in JP 2012-92640 A, not only when the lever member is located in the locked rotational position but also when the lever member is located in the set rotational position, the part of the lever member is present on/within the movement locus of the projection in the door opening direction to restrict the movement of the projection in the door opening direction. Therefore, the projection provided to the connection lever projects necessarily and sufficiently in the vehicle inside direction from an end surface of the connection lever on a vehicle inner side. Therefore, inside the door of the vehicle, a vehicle-width-direction space for providing the projection to the connection lever and a vehicle-width-direction space for allowing the part of the lever member to rotate from the set rotational position to the retracted rotational position are required to be ensured on the vehicle inner side of the connection lever. As a result, space efficiency in the vehicle width direction is low.

The present invention has been made to solve the problem described above, and has a feature in a door outer handle structure for a vehicle, including:

- a base member adapted to be fixed to a door of the vehicle;
- an outer handle provided to the base member so as to be swingable in a vehicle inside-and-outside direction and operable between a door closing position and a door opening position being away from the door closing position in a vehicle outside direction;
- a link mechanism adapted to be capable of transmitting a door opening operation of the outer handle as an unlatching operation of a door latch mechanism; and
- a door opening prevention mechanism configured to restrict actuation of a component of the link mechanism in a door opening direction due to a given inertial force acting in the vehicle outside direction for the door in an event of collision of the vehicle, in which:

the link mechanism includes:

- a bell crank including an input arm portion and an output arm portion each being rotatably assembled to the base member so as to be swingable, the bell crank being engaged with a swinging portion of the outer handle at the input arm portion;
- a spring interposed between the bell crank and the base member, which is configured to bias/urge the bell crank toward the door closing position; and
- a connection lever rotatably assembled to the output arm portion through intermediation of a connection shaft extending in a front-and-rear direction of the vehicle so as to be swingable under a state in which the door is closed, the connection lever being configured to enable an unlatching operation of the door latch mechanism through movement in the door opening direction;

the door opening prevention mechanism includes:

a lever member rotatably assembled to the base member so as to be swingable in the vehicle inside-and-outside direction; and an urging member configured to bias/urge the lever member toward a set position;

the lever member is set to be held in the set position when the outer handle is located in the door closing position under a state in which the inertial force does not act, and to swing in the vehicle outside direction from the set position to be moved to a locked position against an urging force of the urging member when the inertial force acts;

an extended portion of the connection shaft is set to be movable relative to the lever member to allow the movement of the connection lever in the door opening direction when the lever member is located in the set position; and the extended portion of the connection shaft is set to come into contact with the lever member so that the relative movement of the extended portion is restricted when the lever member is located in the locked position, thereby restricting the movement of the connection lever in the door opening direction.

In the above-mentioned door outer handle structure for a vehicle of the present invention, when the lever member is located in the locked position, the extended portion of the connection shaft is set to come into contact with the lever member so that the relative movement of the extended portion is restricted, to thereby restrict the movement of the connection lever in the door opening direction. Therefore, in the event of collision of the vehicle, the movement of the connection lever in the door opening direction can be restricted by the lever member located in the locked position. As a result, the unlatching operation of the door latch mechanism (operation for shifting from a state in which the door is closed (latching state) to a state in which the door can be opened (unlatching state)) can be reliably prevented.

Further, in the above-mentioned door outer handle structure for a vehicle of the present invention, the extended portion of the connection shaft is set to come into contact with the lever member located in the locked position to restrict the movement of the connection lever in the door opening direction. Therefore, when the outer handle is operated from the door closing position to the door opening position, the lever member and the urging member of the door opening prevention mechanism can be arranged in accordance with a vehicle-width-direction space of a region in which the connection shaft moves. Therefore, space efficiency in the vehicle width direction is high inside the door of the vehicle. Accordingly, the door outer handle structure for a vehicle can be configured compactly in the vehicle width direction.

In the implement of the present invention described above, when the outer handle is operated between the door closing position and the door opening position under a state in which the inertial force does not act, the lever member may be set to come into slidable engagement with the extended portion of the connection shaft to be turned against the urging member, to thereby rotate by a predetermined amount with respect to the base member. In this case, along with a normal operation (daily door opening operation) of the outer handle, the lever member rotates within a range of the predetermined amount from the set position in cooperation with the urging member. Therefore, dust and dirt can be prevented from adhering to and being fixed to a rotating portion of the lever member. Accordingly, the rotation of the lever member with respect to the base member can be ensured for a long period of time.

To carry out the present invention described above, the lever member may be set to swing in the vehicle inside direction from the set position to be moved to a second locked position against the urging force of the urging member when an inertial force having the the same degree as the above inertial force acts in a direction (vehicle inside direction) opposite to a direction of the inertial force, and the extended portion of the connection shaft may be set to come into contact with the lever member so that the relative movement of the extended portion is restricted when the lever member is located in the second locked position, thereby restricting the movement of the connection lever in the door opening direction. In this case, not only when the lever member is located in the locked position but also when the lever member is located in the second locked position, the extended portion of the connection shaft comes into contact with the lever member so that the relative movement of the extended portion is restricted, thereby restricting the movement of the connection lever in the door opening direction. Therefore, in the event of collision of the vehicle, even when the direction of the inertial force generated due to the event of collision is reversed alternately in the vehicle inside-and-outside direction and thus the inertial force acting on the lever member fluctuates in the vehicle inside-and-outside direction, the movement of the connection lever in the door opening direction can be restricted by the lever member located in the locked position (a given inertial force (positive G) acts in the vehicle outside direction in this case), or by the lever member located in the second locked position (a given inertial force (negative G) acts in the vehicle inside direction in this case). As a result, the unlatching operation of the door latch mechanism can be reliably prevented.

BRIEF DESCRIPTION OF DRAWINGS

FIG. 3 is moved to a locked position by a given inertial force acting in a vehicle outside direction for the door in the event of collision of the vehicle.

DESCRIPTION OF EMBODIMENT

Figure 1:
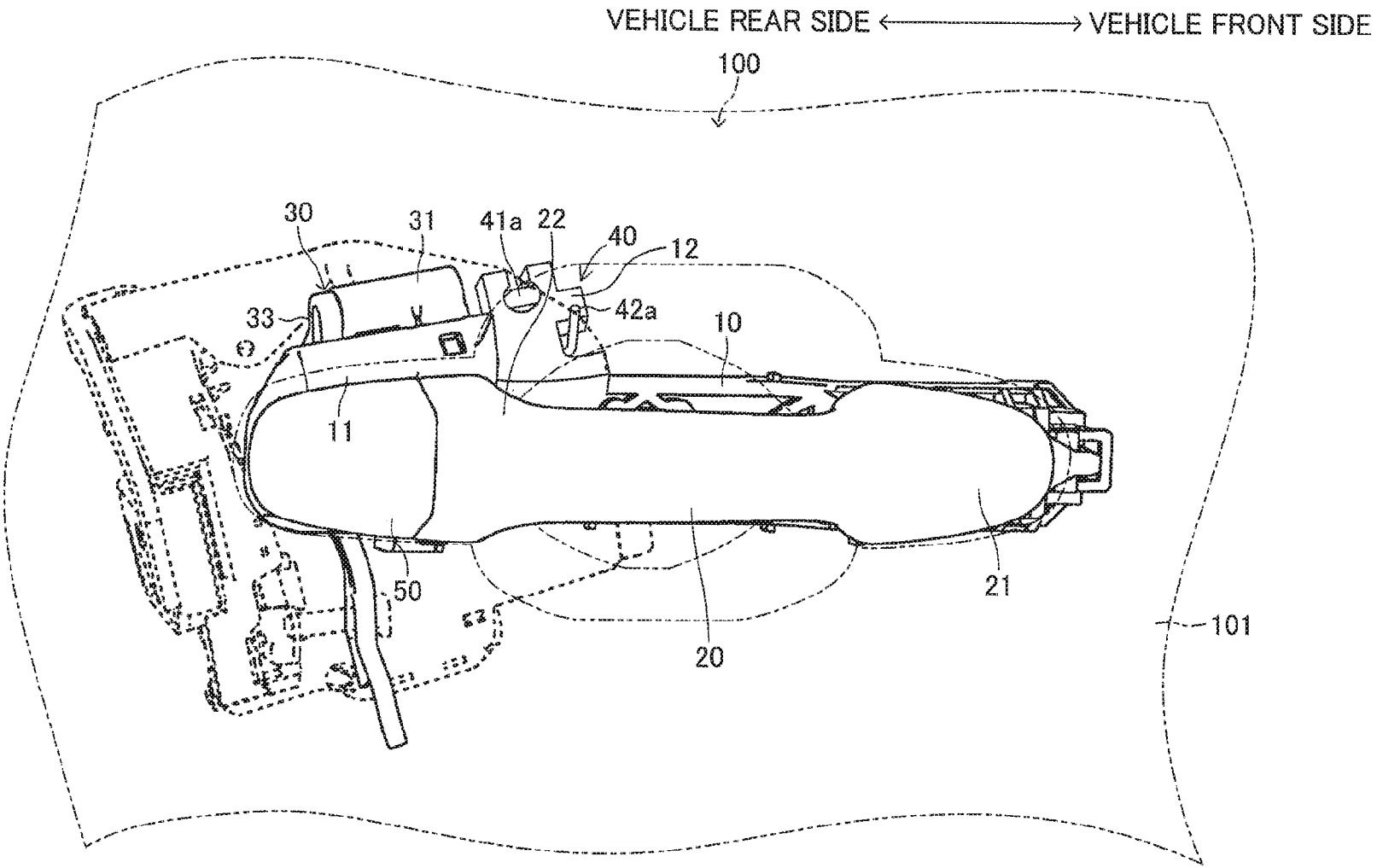
FIG. 1 is a partial perspective view of a vehicle door including a door outer handle structure for a vehicle according to one embodiment of the present invention when viewed from outside of the vehicle.

An embodiment of the present invention will next be described referring to the drawings. FIG. 1 to FIG. 5 are illustrations of a vehicle door including a door outer handle structure for a vehicle according to one embodiment of the present invention. In the door outer handle structure of this embodiment, as illustrated in FIG. 1, a base member 10 is fixed to a door 100 mounted to a rear right side of a vehicle.

The base member 10 has an outer handle 20, a link mechanism 30, a door opening prevention mechanism 40, and the like assembled thereto. The base member 10 is fixed to an inner side of an outer panel 101 of the door 100. A cap 50 (configured to retain the outer handle 20 to the base member 10) is assembled to a vehicle rear-side end portion 11 in a state of interposing the outer panel 101 therebetween.

The outer handle 20 is a grip-type handle provided to the base member 10 in an approximately horizontal state so as to be swingable in a vehicle inside-and-outside direction (vehicle width direction). The outer handle 20 is assembled to the base member 10 in a state of interposing the outer panel 101 therebetween, and is configured to be operable between a door closing position and a door opening position (not shown) being away therefrom in a vehicle outside direction. The outer handle 20 is assembled to the base member 10 at a vehicle front-side end portion 21 so as to be swingable in the vehicle inside-and-outside direction, and is configured such that a vehicle rear-side end portion 22 is movable from a position illustrated in FIG. 1 in the vehicle outside direction by a required amount. Further, an engagement portion 22*a* (see FIG. 2) to be engaged with a bell crank 31, which is a component of the link mechanism 30, is formed on the vehicle rear-side end portion 22 of the outer handle 20. When the outer handle 20 is located in the door closing position, an upper end portion and a lower end portion of the outer handle 20 are held in engagement with (in contact with) the outer panel 101 through intermediation of a cushion (not shown).

The link mechanism 30 can transmit a door opening operation of the outer handle 20 in the vehicle outside direction as an unlatching operation (operation for shifting from a latching state to an unlatching state) of a door latch mechanism (not shown), and includes the above-mentioned bell crank 31, a coil spring 32, and a connection lever 33. The door latch mechanism (not shown) is well known, and includes a striker fixed to a vehicle body side, a latch and a pawl assembled to the door 100 side, and the like. In the latching state, the pawl restricts rotation of the latch that is engaged with the striker to disable the door opening operation (operation of opening the closed door 100). In the unlatching state, the pawl allows the rotation of the latch that is engaged with the striker to enable the door opening operation.

Figure 3:
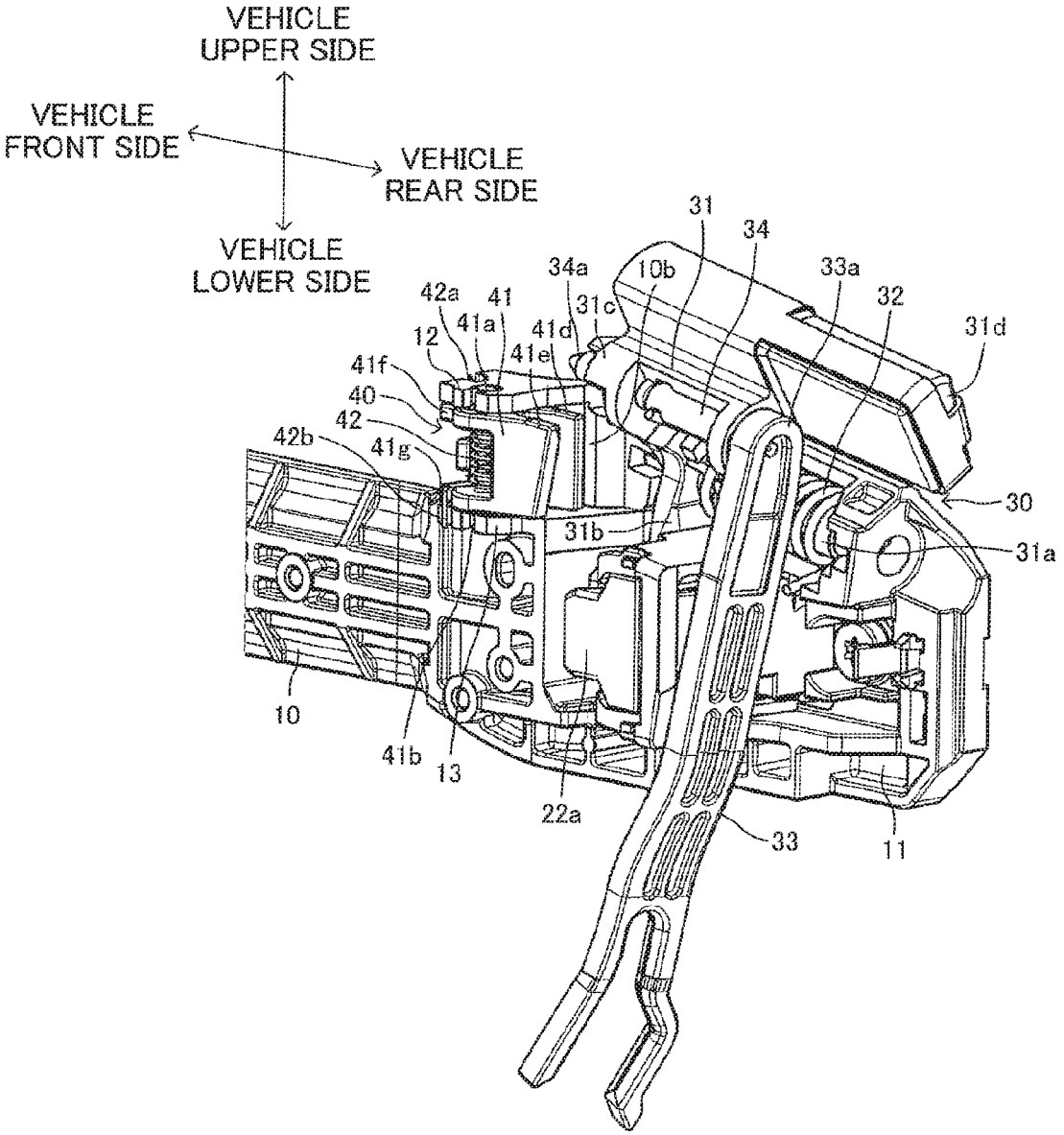
FIG. 3 is a perspective view of the main structure illustrated in FIG. 2 when viewed from the inner side of the door and a rear side of the vehicle.

The bell crank 31 is rotatably assembled to the base member 10 at a shaft portion 31*a* extending in a front-and-rear direction of the vehicle under a state in which the door 100 is closed, and includes an input arm portion 31*b* and an output arm portion 31*c*, as illustrated in FIG. 3. The input arm portion 31*b* extends downward in a radial direction of the shaft portion 31*a*, and has a distal end engaged with (in contact with) a vehicle outer-side surface of the engagement portion 22*a* of the outer handle 20. The output arm portion 31*c* extends upward in the radial direction of the shaft portion 31*a* and is integrally connected to an upper end portion 33*a* of the connection lever 33 through intermediation of a connection shaft 34 (that may be formed integrally with the connection lever 33). A weight portion (inertia portion) 31*d* extending along the shaft portion 31*a* can be provided to the output arm portion 31*c* to carry out the present embodiment. The weight portion (inertia portion) 31*d* is configured to restrict opening actuation of the outer handle 20 due to an inertial force acting in the vehicle outside direction for the door 100 in the event of collision of the vehicle. The restricting force is set based on a mass of the weight portion (inertia portion) 31*d* and an urging/biasing force of the coil spring 32.

Figure 2:
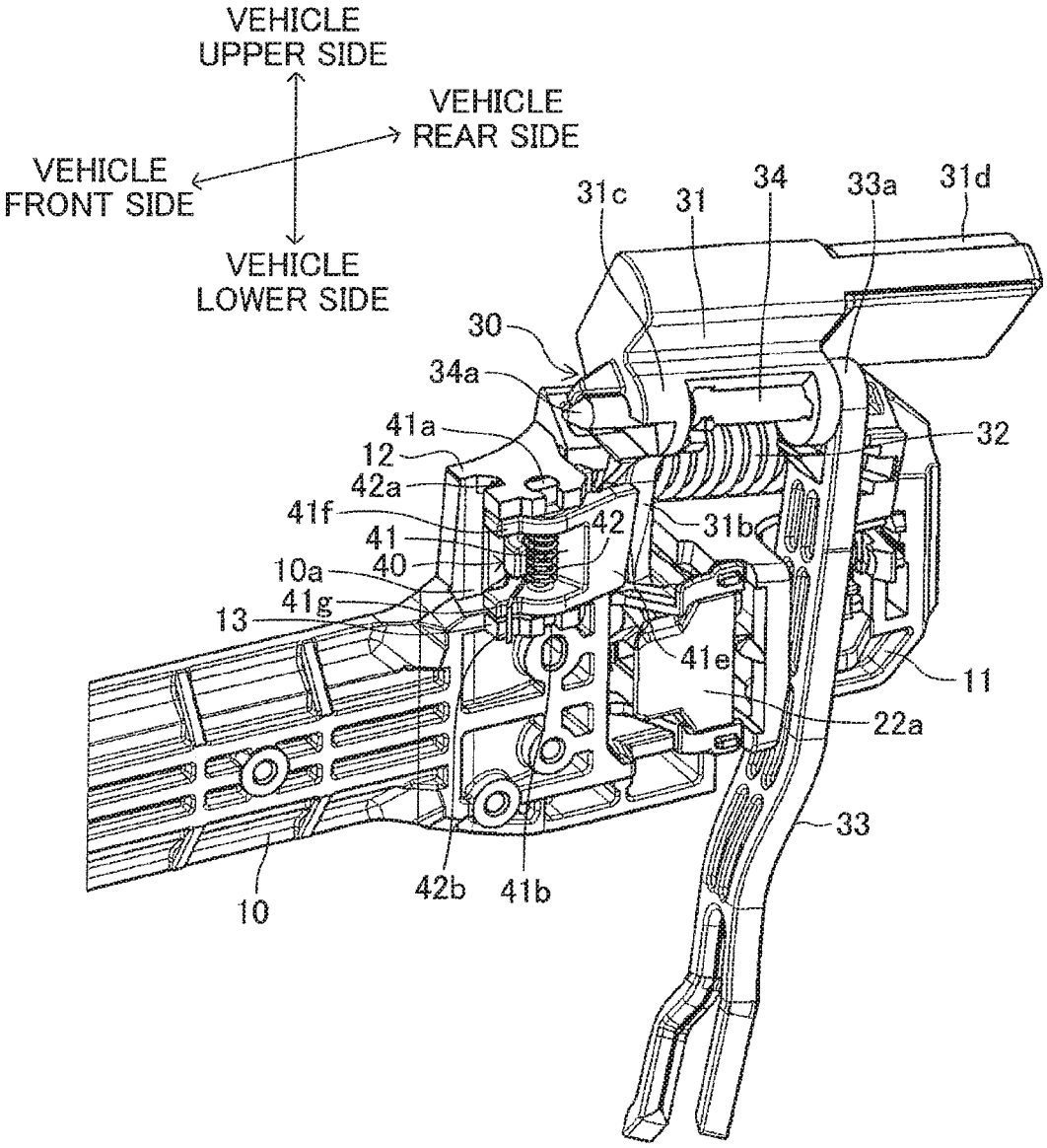
FIG. 2 is a perspective view for illustrating a main structure of the door outer handle structure for a vehicle illustrated in FIG. 1 when viewed from an inner side of the door and a front side of the vehicle.

The coil spring 32 is a return spring configured to bias the bell crank 31 and the outer handle 20 to the door closing position (initial position) illustrated in FIG. 2 and FIG. 3 (component configured to automatically return the outer handle 20 from the door opening position to the door closing position). The coil spring 32 is assembled to an outer circumference of the shaft portion 31*a* of the bell crank 31, and is engaged with the base member 10 at one end and engaged with the bell crank 31 at the other end, to thereby rotationally urge/bias the input arm portion 31*b* of the bell crank 31 with a predetermined urging force in a direction in which the input arm portion 31*b* comes into engagement with the engagement portion 22*a* of the outer handle 20. Therefore, the input arm portion 31*b* of the bell crank 31 is elastically engaged with the engagement portion 22*a* of the outer handle 20.

The connection lever 33 is connected to the output arm portion 31*c* of the bell crank 31 at the upper end portion 33*a* through intermediation of the connection shaft 34. The connection lever 33 is engaged with an outside open lever (not shown) linking with the pawl (not shown) of the door latch mechanism at a lower end portion (not shown). Thus, the connection lever 33 is configured to move downward from the initial position illustrated in FIG. 2 and FIG. 3 by a predetermined amount when the outer handle 20 is operated from the door closing position to the door opening position so that the bell crank 31 rotates by a predetermined amount against the urging force of the coil spring 32.

The connection shaft 34 extends in the front-and-rear direction of the vehicle under a state in which the door 100 is closed, and is rotatably assembled to the output arm portion 31 of the bell crank 31 at its both front and rear end portions so as to be swingable together with the bell crank 31. The connection shaft 34 is integrally connected to the upper end portion 33*a* of the connection lever 33 at the rear end. Therefore, when the outer handle 20 is moved in the door opening direction from the door closing position to the door opening position, the connection shaft 34 and the connection lever 33 are driven by the bell crank 31 to be moved downward, thereby enabling the unlatching operation of the door latch mechanism by the connection lever 33. Further, at the front end of the connection shaft 34, an extended portion 34*a* having a conical shape that is tapered toward a distal end is formed integrally therewith.

The above-mentioned link mechanism 30 is set so that the door latch mechanism is brought into the latching state when the outer handle 20 is located in the door closing position and the connection lever 33 is located in the initial position under the state in which the door 100 is closed, and the door latch mechanism is brought into the unlatching state when the outer handle 20 is operated from the door closing position to the door opening position to move the connection lever 33 downward from the initial position by the predetermined amount. Therefore, the rotation of the bell crank 31 against the urging force of the coil spring 32 and the downward movement of the connection lever 33 and the connection shaft 34 correspond to actuation in the door opening direction.

The door opening prevention mechanism 40 restricts the downward movement (actuation in the door opening direction) of the connection lever 33 and the connection shaft 34 of the link mechanism 30 by a given inertial force acting in the vehicle outside direction for the door 100 in the event of collision of the vehicle under the state in which the door 100 is closed, and includes a lever member 41 rotatably assembled to the base member 10 and a coil spring 42 assembled between the lever member 41 and the base member 10.

Figure 5:
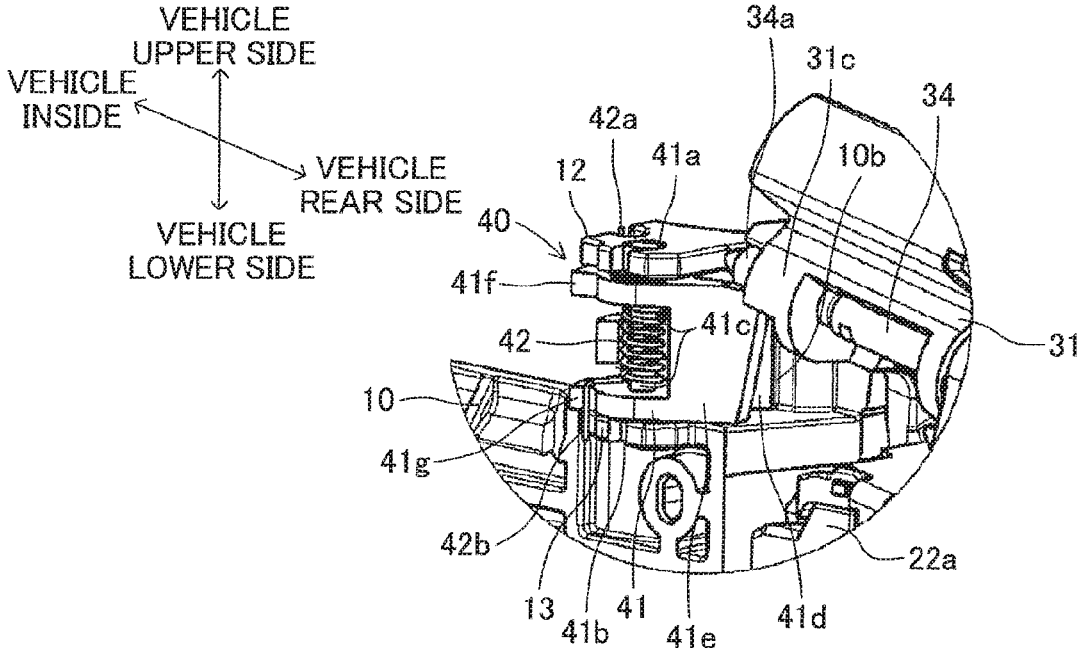
FIG. 5 is a perspective view of a main portion when the lever member located in a set position illustrated in FIG. 2

The lever member 41 includes, as illustrated in FIG. 2 and FIG. 3, an upper shaft portion 41*a* and a lower shaft portion 41*b* that are provided coaxially, and a pair of upper and lower spring mounting shaft portions 41*c* (see FIG. 5). The lever member 41 also includes a pair of inner and outer engagement projecting portions 41*d* and 41*e* and a pair of upper and lower spring locking portions 41*f* and 41*g*. The lever member 41 is rotatable from a set position (initial rotational position) illustrated in FIG. 2 and FIG. 3 to a locked position being away therefrom in the vehicle outside direction illustrated in FIG. 5 or a second locked position being away therefrom in the vehicle inside direction (not shown).

The upper shaft portion 41*a* is rotatably assembled to an upper supporting portion 12 of the base member 10 so as to be immovable in an axial direction vertical direction). The lower shaft portion 41*b* is rotatably assembled to a lower supporting portion 13 of the base member 10 so as to be immovable in the axial direction (vertical direction). Each of the spring mounting shaft portions 41*c* is provided between the upper shaft portion 41*a* and the lower shaft portion 41*b* so as to be coaxial with the upper shaft portion 41*a* and the lower shaft portion 41*b*, and supports an upper end portion and a lower end portion (coil portions) of the coil spring 42 in an expandable and contractable manner.

When the lever member 41 is located in the set position, the outer engagement projecting portion 41*d* extends along an axial direction of the connection shaft 34 and is present out of a movement locus (see the broken line of FIG. 4) of the extended portion 34*a* of the connection shaft 34, the locus being formed along with the operation of the outer handle 20. Therefore, the extended portion 34*a* of the connection shaft 34 is movable relative to the engagement projecting portion 41*d*, thereby allowing the movement of the connection shaft 34 and the connection lever 33 in the door opening direction. Further, when the lever member 41 is moved from the set position to the second locked position (inner locked position), the outer engagement projecting portion 41*d* moves to be on/within the movement locus of the extended portion 34*a* of the connection shaft 34, the locus being formed along with the operation of the outer handle 20. Therefore, the extended portion 34*a* of the connection shaft 34 comes into contact with the engagement projecting portion 41*d* so that the relative movement thereof is restricted, thereby restricting the movement of the connection shaft 34 and the connection lever 33 in the door opening direction. When the lever member 41 is moved from the set position to the second locked position, the lower spring locking portion 41*g* comes into contact with a stopper surface 10*a* of the base member 10 (see FIG. 2) so that inward rotation (swing) of the lever member 41 is restricted.

Figure 4:
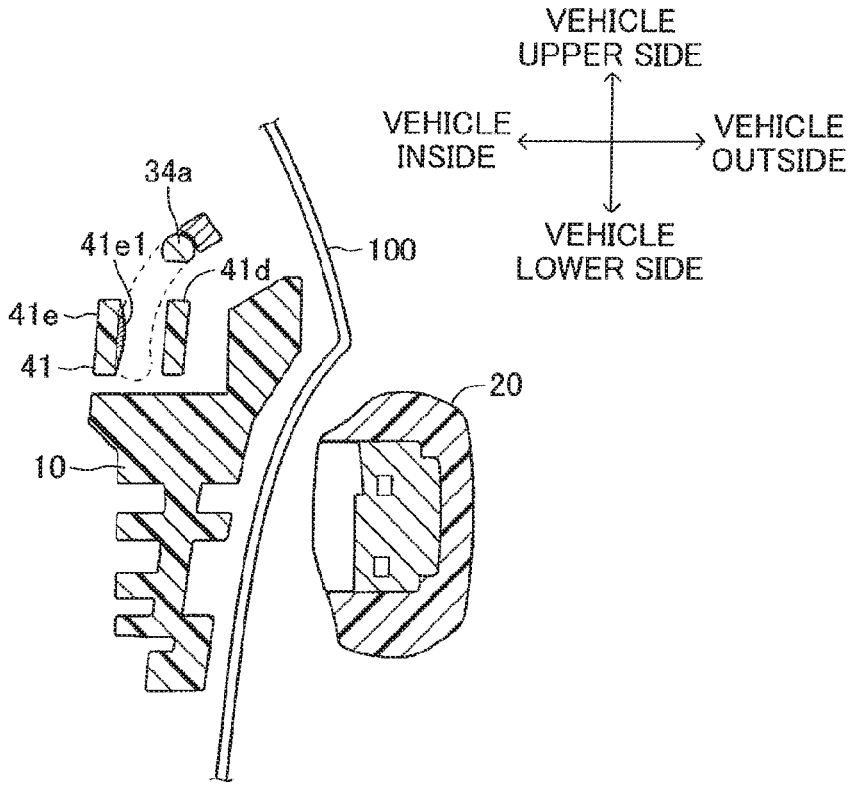
FIG. 4 is a partial vertical sectional rear view for schematically illustrating a relationship between an extended portion of a connection shaft and a lever member illustrated in FIG. 2 and FIG. 3.

The inner engagement projecting portion 41*e* includes an arc-like projection 41*e*1 formed on an its outer side surface, as illustrated in FIG. 4. When the lever member 41 is located in the set position, the inner engagement projecting portion 41*e* extends along the axial direction of the connection shaft 34 and a portion other than the arc-like projection 41*e*1 is located out of the movement locus of the extended portion 34*a* of the connection shaft 34, the locus being formed along with the operation of the outer handle 20. Therefore, the extended portion 34*a* of the connection shaft 34 is movable relative to the engagement projecting portion 41*e*, thereby allowing the movement of the connection shaft 34 and the connection lever 33 in the door opening direction. However, the arc-like projection 41*e*1 is present on/within the movement locus of the extended portion 34*a* of the connection shaft 34, the locus being formed along with the operation of the outer handle 20. Thus, when the outer handle 20 is operated between the door closing position and the door opening position (at the time of the movement of the connection shaft 34 and the connection lever 33 in the door opening direction and at the time of returning movement of them), the extended portion 34*a* of the connection shaft 34 and the arc-like projection 41*e*1 come into slidable engagement with each other and are turned against the urging force of the coil spring 42. As a result, the lever member 41 rotates by a predetermined amount with respect to the base member 10.

When the lever member 41 is moved from the set position to the locked position (outer locked position), the inner engagement projecting portion 41*e* moves to be on/within the movement locus of the extended portion 34*a* of the connection shaft 34, the locus being formed along with the operation of the outer handle 20. Therefore, the extended portion 34*a* of the connection shaft 34 comes into contact with the engagement projecting portion 41*e* so that the relative movement thereof is restricted, thereby restricting the movement of the connection shaft 34 and the connection lever 33 in the door opening direction. When the lever member 41 is moved from the set position to the locked position, the outer engagement projecting portion 41*d* comes into contact with a stopper surface 10*b* (see FIG. 3) of the base member 10 to restrict outward rotation (swing) of the lever member 41.

The upper spring locking portion 41*f* extends forward, and is set to be engaged with the upper end portion 42*a* of the coil spring 42 so as to be subjected to the urging force of the coil spring 42 when the lever member 41 is located in the set position and when the lever member 41 rotates inward from the set position. When the lever member 41 is located in the set position and when the lever member 41 rotates inward from the set position, the lower end portion 42*b* of the coil spring 42 is engaged with the lower supporting portion 13 of the base member 10.

The lower spring locking portion 41*g* extends forward, and is set to be engaged with the lower end portion 42*b* of the coil spring 42 so as to be subjected to the urging force of the coil spring 42 when the lever member 41 is located in the set position and when the lever member 41 rotates outward from the set position. When the lever member 41 is located in the set position and when the lever member 41 rotates outward from the set position, the upper end portion 42*a* of the coil spring 42 is engaged with the upper supporting portion 12 of the base member 10.

In this embodiment configured as described above, when the lever member 41 is located in the locked position, the extended portion 34*a* of the connection shaft 34 is set to come into contact with the lever member 41 so that the relative movement thereof is restricted, thereby restricting the movement of the connection lever 33 in the door opening direction. Therefore, in the event of collision of the vehicle, the movement of the connection lever 33 in the door opening direction can be restricted by the lever member 41 which is located in the locked position. As a result, the unlatching operation of the door latch mechanism (operation for shifting from a state in which the door is closed (latching state) to a state in which the door can be opened (unlatching state)) can be reliably prevented.

Further, in this embodiment, the extended portion 34*a* of the connection shaft 34 is set to come into contact with the lever member 41 located in the locked position to restrict the movement of the connection lever 33 in the door opening direction. Therefore, when the outer handle 20 is operated from the door closing position to the door opening position, the lever member 41 and the coil spring 42 of the door opening prevention mechanism 40 can be arranged in accordance with a vehicle-width-direction space of a region in which the connection shaft 34 moves. Therefore, space efficiency in the vehicle width direction is high inside the door 100 of the vehicle. Thus, the door outer handle structure for a vehicle can be configured compactly in the vehicle width direction.

Further, in this embodiment, when the outer handle 20 is operated between the door closing position and the door opening position under a state in which the inertial force (inertial force in the vehicle outside direction) does not act, the extended portion 34*e* of the connection shaft 34 and the arc-like projection 41*e*1 of the lever member 41 come into slidable engagement with each other. In this manner, the lever member 41 is set to be turned against the urging force of the coil spring 42 so as to rotate by the predetermined amount with respect to the base member 10. Therefore, along with a normal operation (daily door opening operation) of the outer handle 20, the lever member 41 rotates within a range of the predetermined amount from the set position in cooperation with the coil spring 42. Therefore, dust and dirt can be prevented from adhering to a rotating portion of the lever member 41 to be fixed thereto. In this manner, the rotation of the lever member 41 with respect to the base member 10 can be ensured for a long period of time.

Further, in this embodiment, when the same degree of inertial force as that of the above-mentioned inertial force (inertial force in the vehicle outside direction) acts in the opposite direction (vehicle inside direction) to that of the above-mentioned inertial force (inertial force in the vehicle outside direction), the lever member 41 is set to swing in the vehicle inside direction from the set position to be moved to the second locked position against the urging force of the coil spring 42. When the lever member 41 is located in the second locked position, the extended portion 34*a* of the connection shaft 34 is set to come into contact with the outer engagement projecting portion 41*d* of the lever member 41 so that the relative movement thereof is restricted, thereby restricting the movement of the connection lever 33 in the door opening direction.

In this manner, not only when the lever member 41 is located in the locked position but also when the lever member 41 is located in the second locked position, the extended portion 34*a* of the connection shaft 34 comes into contact with the lever member 41 so that the relative movement thereof is restricted, thereby restricting the movement of the connection lever 33 in the door opening direction. Therefore, in the event of collision of the vehicle, even if the direction of the inertial force generated in the event of collision of the vehicle is reversed alternately in the vehicle inside-and-outside direction so that the inertial force acting on the lever member 41 fluctuates in the vehicle inside-and-outside direction, the movement of the connection lever 33 in the door opening direction can be restricted by the lever member 41 located in the locked position (a given inertial force (positive G) acts in the vehicle outside direction in this case) or the lever member 41 located in the second locked position (a given inertial force (negative G) acts in the vehicle inside direction in this case). As a result, the unlatching operation of the door latch mechanism can be reliably prevented.

The embodiment described above is carried out by providing the door outer handle structure for a vehicle according to the present invention to the door 100 mounted on the rear right side of the vehicle. However, the door outer handle structure for a vehicle according to the present invention can be implemented not only for a door mounted on a rear left side of the vehicle but also for a door mounted on a front right side or a front left side of the vehicle in the same manner or with an appropriate change. Further, the door outer handle structure for a vehicle according to the present invention can be implemented for a door mounted on a rear side of the vehicle (back door) in the same manner or with an appropriate change. Further, although the weight portion (inertia portion) 31*d* is provided to the bell crank 31 in the embodiment described above, the weight portion (inertia portion) 31*d* is not necessarily required to be provided to the bell crank 31.

The invention claimed is:

1. A door outer handle structure for a vehicle, comprising:

a base member adapted to be fixed to a door of said vehicle;

an outer handle provided to said base member so as to be swingable in a vehicle inside-and-outside direction and operable between a door closing position and a door opening position being away from said door closing position in a vehicle outside direction;

a link mechanism adapted to be capable of transmitting a door opening operation of said outer handle as an unlatching operation of a door latch mechanism; and a door opening prevention mechanism configured to restrict actuation of a component of said link mechanism in a door opening direction due to a given first inertial force acting in said vehicle outside direction for said door in an event of collision of said vehicle, wherein:

said link mechanism comprises:

a bell crank comprising an input arm portion and an output arm portion each being rotatably assembled to said base member so as to be swingable, said bell crank being engaged with a swinging portion of said outer handle at said input arm portion;

a spring interposed between said bell crank and said base member, said spring being configured to bias said bell crank toward said door closing position; and a connection lever rotatably assembled to said output arm portion through intermediation of a connection shaft extending in a front-and-rear direction of said vehicle so as to be swingable under a state in which said door is closed, said connection lever being configured to enable an unlatching operation of said door latch mechanism through movement in said door opening direction;

said door opening prevention mechanism comprises:

a lever member rotatably assembled to said base member so as to be swingable in said vehicle inside-and-outside direction; and an urging member configured to urge said lever member toward a set position;

said lever member is set to be held in said set position when said outer handle is located in said door closing position under a state in which said first inertial force does not act, and to swing in said vehicle outside direction from said set position to be moved to a locked position against an urging force of said urging member when said first inertial force acts;

an extended portion of said connection shaft is set to be movable relative to said lever member to allow said movement of said connection lever in said door opening direction when said lever member is located in said set position; and said extended portion of said connection shaft is set to come into contact with said lever member so that said relative movement of said extended portion is restricted when said lever member is located in said locked position, to thereby restrict said movement of said connection lever in said door opening direction, wherein, when said outer handle is operated between said door closing position and said door opening position under a state in which said first inertial force does not act, said lever member is set to come into slidable engagement with said extended portion of said connection shaft to be turned against said urging member, to thereby rotate by a predetermined amount with respect to said base member.

2. A door outer handle structure for a vehicle according to claim 1, wherein:

said lever member is set to swing in said vehicle inside direction from said set position to be moved to a second locked position against said urging force of said urging member when a second inertial force which has said same degree as said first inertial force acts in an direction opposite to a direction of said first inertial force; and said extended portion of said connection shaft is set to come into contact with said lever member so that said relative movement of said extended portion is restricted when said lever member is located in said second locked position, to thereby restrict said movement of said connection lever in said door opening direction.

* * * * *